US006782812B2

(12) United States Patent
Hasegawa et al.

(10) Patent No.: US 6,782,812 B2
(45) Date of Patent: Aug. 31, 2004

(54) STENCIL-PRINTER

(75) Inventors: Toshiharu Hasegawa, Shibata-gun (JP); Kenro Takeda, Shibata-gun (JP); Shoji Imazeki, Shibata-gun (JP); Yoshihito Ebina, Shibata-gun (JP); Hiromi Omura, Shibata-gun (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/609,647

(22) Filed: Jul. 1, 2003

(65) Prior Publication Data

US 2004/0050265 A1 Mar. 18, 2004

(30) Foreign Application Priority Data

Jul. 4, 2002 (JP) ..... 2002-195947

(51) Int. Cl.[7] ..... B41C 1/14; B41L 13/04

(52) U.S. Cl. ..... 101/128.4; 101/117; 101/129; 101/484

(58) Field of Search ..... 101/116, 117, 101/118, 128.4, 129, 484

(56) References Cited

U.S. PATENT DOCUMENTS 5,575,205 A * 11/1996 Iida ..... 101/116
6,158,337 A * 12/2000 Hara ..... 101/116
6,401,607 B2 * 6/2002 Yoneoka ..... 101/129

FOREIGN PATENT DOCUMENTS

| | | |
|---|---|---|
| JP | 7-257002 | 10/1995 |
| JP | 7-257003 | 10/1995 |
| JP | 9-71029 | 3/1997 |

* cited by examiner

*Primary Examiner*—Daniel J. Colilla
*Assistant Examiner*—Jill E. Culler
(74) *Attorney, Agent, or Firm*—Oblon, Spivak, McClelland, Maier & Neustadt, P.C.

(57) ABSTRACT

A stencil printer of the present invention includes a print drum around which perforated part of a stencil or master is to be wrapped. A master making section make a master and includes a cutter for cutting the stencil paid out from a roll. A master discharging section removes the master wrapped around the print drum and then discharges it. A deciding device determines, on the turn-on of a power supply, whether or not the power supply has been turned off during an interval between the time when the stencil paid out from the roll starts being perforated and the time when the cutter cuts the stencil. When the deciding device determines that the power supply has been turned off during the above interval, the master discharging section discharges the master present on the print drum.

6 Claims, 3 Drawing Sheets

STENCIL-PRINTER

BACKGROUND OF THE INVENTION

1. Field of the Invention

The present invention relates to a stencil printer and more particularly to control to be executed over a stencil printer when the power supply of the printer is turned on after turn-off.

2. Description of the Background Art

A thermosensitive, digital stencil printer using a laminate type of stencil is conventional. The laminate type of stencil is made up of a thermoplastic resin film and a porous base adhered to the resin film and implemented by Japanese paper fibers or synthetic fibers or a mixture thereof. The stencil printer includes a rotatable print drum consisting of a hollow, porous support and a plurality of mesh screens wrapped around the support in a laminate and formed of resin or metal. After the resin film of the stencil has been perforated or cut by, e.g., a thermal head, the stencil is wrapped around the print drum. While ink is fed from ink feeding means arranged inside the print drum, press roller or similar pressing means continuously presses a sheet fed from sheet feeding means against the perforated stencil (master hereinafter) wrapped around the print drum. As a result, the ink is transferred to the sheet via the porous portion of the print drum and the perforations of the master, printing an image on the sheet.

Today, the stencil printer described above can automatically, continuously execute a sequence of steps of image reading, master discharging, master making, master wrapping, printing and so forth and implements high image accuracy and low printing cost. With these advantages, the stencil printer is replacing a copier when it comes to users of the kind usually desiring about ten or more prints.

The conventional stencil printer immediately stops operating when the main switch of the printer is accidentally turned off by hand or due to a power failure or the operation of a circuit breaker. Assume that the main power supply is turned off when the perforation of the master is under way, and again turned on. Then, in a first type conventional stencil printer configured to wrap the master around the print drum while perforating the master, the stencil is cut on the turn-on of the main power supply. On the other hand, in a second type of conventional stencil printer configured to stock the perforated portion of the stencil corresponding to a single master, the master is cut away on the turn-on of the main power supply and then wrapped around the print drum.

However, the problem with the first type of stencil printer stated above is that the cut piece of the master must be removed by hand before the turn-on of the power supply because the master has been cut without regard to its length, resulting in troublesome work. On the other hand, in the second type of stencil printer, because the master with a short length is left on the print drum, it is likely that the porous portion of the print drum is not entirely covered with the master when the main power supply is again turned on. This brings about a problem that the trailing edge of a sheet is smeared with ink, a problem that ink deposits on the press roller, and a problem that ink flown away via the porous portion of the print drum smears the inside of the printer.

Technologies relating to the present invention are disclosed in, e.g., Japanese Patent Laid-Open Publication No. 7-257002, 7-257003 and 9-71029.

SUMMARY OF THE INVENTION

It is an object of the present invention to provide a stencil printer capable of resuming, when a power supply thereof is turn on after turn-off occurred during master making operation, the master making operation while promoting efficient work and protecting itself and a sheet from smears.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
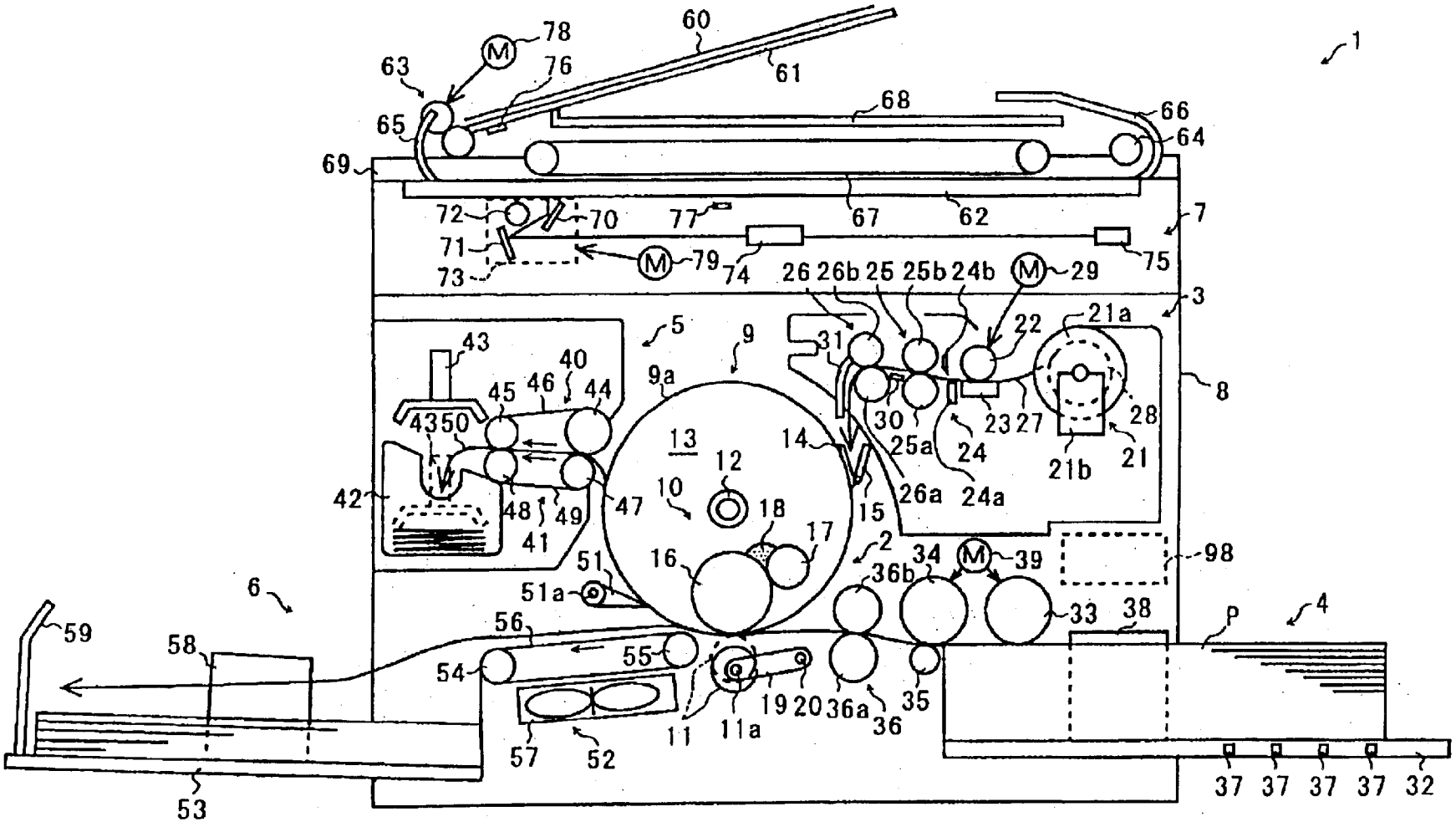
FIG. 1 is a front view showing a stencil printer embodying the present invention.

Referring to FIG. 1 of the drawings, a stencil printer embodying the present invention is shown and generally designated by the reference numeral 1. As shown, the stencil printer 1 is generally made up of a printing section 2, a master making section 3, a sheet feeding section 4, a master discharging section 5, a sheet discharging section 6, and an image reading section 7. These sections 2 through 7 are arranged inside a casing 8.

The printing section 2, located at substantially the center of the casing 8, includes a print drum 9, ink feeding means 10, and a press roller 11. The print drum 9 includes a pair of opposite end plates 13 (only one is visible) rotatably supported by a shaft 12 via bearings, not shown, and a porous support 9*a* wrapped around the end plates 13. Drum drive means, not shown, causes the print drum 9 to rotate clockwise, as viewed in FIG. 1. The shaft 12 is formed with a plurality of small holes for feeding ink to the ink feeding means 10 and, in this sense, plays the role of an ink feed pipe at the same time.

The porous support 9*a*, implemented as a sheet of stainless steel by way of example, has a porous portion formed with a number of pores and a non-porous portion. The porous portion has a length, as measured in the circumferential direction, great enough to print an image on a sheet of size A3. A stage 14 is mounted on the non-porous portion and has a surface extending in the axial direction of the drum 9. A clamper 15 is positioned on the top of the stage 14 and opened and then closed to clamp the leading edge of a cut stencil or master 27, as will be described specifically later. One to three mesh screens are wrapped around the porous portion of the porous support 9*a* in a laminate and implemented by thin filaments of, e.g., polyester or stainless steel.

The ink feeding means 10 is arranged below the shaft 12 inside the print drum 9 and includes an ink roller 16 and a doctor roller 17. The ink roller 16 is rotatably supported by a pair of side plates affixed to the shaft 12 between the end plates 13 and is caused to rotate in the same direction as the print drum 9 by drive means not shown. The doctor roller 17 is also rotatably supported by the above side plates in the vicinity of the doctor roller 17 and rotated in the opposite direction to the ink roller 16 by drive means not shown. Ink fed from the shaft 12 forms a generally wedge-shaped ink well 18 between the portions of the ink roller 16 and doctor roller 17 adjoining each other.

An encoder, not shown, is mounted on the print drum 9 and sends information representative of the angular position of the print drum 9 to control means 98, which will be described specifically later.

A press roller 11 is positioned beneath the print drum 9 and provided with substantially the same axial length as the print drum 9. The press roller 11 is made up of a core 11*a* and an elastic member wrapped around the core 11*a* and formed of, e.g., rubber. Opposite ends of the core 11*a* each are rotatably supported by one end of a pair of flat, press roller arms 19 (only one is visible). The other end of each press roller arm 19 is affixed to one end of a press roller shaft 20, which is pivotably supported by the casing 8. In this configuration, press roller moving means, not shown, causes the press roller arms 19 to angularly move together via the press roller shaft 20. The press roller 11 is therefore selectively moved between an inoperative position released from the print drum 9, as indicated by a solid line in FIG. 1, and an operative position pressed against the print drum 9, as indicated by a dotted line in FIG. 1.

The master making section 3, positioned above and at the right-hand side of the printing section 2, includes a stencil storing member 21, a platen roller 22, a thermal head 23, cutting means or cutter 24, and roller pairs 25 and 26. These constituents of the master making section 3 all are constructed into a single unit removably mounted to the casing 8.

The stencil storing member 21 is made up of a pair of disk-like roll support members 21*a* (only one is visible) and a pair of support members 21*b*. Lugs protrude from opposite sides of each roll support member 21*a*. A stencil 27 is a laminate of a thermoplastic resin film and a porous base adhered together and is wound round a core in the form of a roll 28. One of the lugs, protruding from the opposite sides of each roll support member 21*a*, is inserted in the core to thereby support the roll 28. The other lug of each roll support member 21*a* is received in a slit formed in associated one of the support members 21*b*. In this configuration, the roll 28 is rotatably supported by the support members 21*b* via the roll support members 21*a*.

The platen roller 22 and thermal head 23 are positioned downstream of the stencil storing member 21 in the direction of stencil conveyance. The platen roller 22 is rotatably supported by opposite side walls, not shown, included in the master making section 3 and is caused to rotate by a stepping motor 29. The thermal head 23 has a number of heat generating elements arranged on its top and mounted on the above side walls. Biasing means, not shown, constantly biases the thermal head 23 toward the platen roller 22 such that the thermal head 23 is pressed against the platen roller 22 by preselected pressure. In this condition, the heat generating elements of the thermal head 23 are selectively energized to perforate, or cut, the stencil 27 being conveyed via the thermal head 23.

The cutting means 24 is positioned downstream of the platen roller 22 and thermal head 23 in the direction of stencil conveyance and configured to cut the stencil 27 at preselected length with a conventional mechanism. More specifically, the cutting means 24 includes a stationary edge 24*a* affixed to the master making section 3 and a movable edge 24*b*. The movable edge 24*b* is moved relatively to the stationary edge 24*a* while being rotated, cutting the stencil 27.

The roller pairs 25 and 26 and stencil guides 30 and 31 are positioned downstream of the cutting means 24 in the direction of stencil conveyance. The roller pairs 25 and 26 respectively have drive rollers 25*a* and 26*a* driven in synchronism with each other by drive means, not shown, and driven rollers 25*b* and 26*b* pressed against the drive rollers 25 and 26*a*, respectively, by biasing means not shown. The stencil guide 30 is positioned between the roller pairs 25 and 26 while the stencil guide 31 is positioned downstream of the roller pair 26 in the direction of stencil conveyance. The stencil guides 30 and 31, affixed to the side walls of the master making section 3, guide the leading edge of the perforated stencil or master 27 being conveyed by the roller pairs 25 and 26 toward the circumference of the print drum 9.

The sheet feeding section 4 is positioned below the master making section 3 and includes a sheet tray 32, a pickup roller 33, a separator roller 34, a reverse roller 35, and a registration roller pair 36. The sheet tray 32 is loaded with a stack of sheets P and is selectively raised or lowered by elevating means not shown. A plurality of sheet size sensors 37 responsive to the size of the sheets P and a pair of side fences 38 (only one is visible) are mounted on the sheet tray 32. The side fences 38 are movable toward or away from each other in matching relation to the width of the sheets P as conventional. In the illustrative embodiment, the sensors 37 each are implemented as a reflection type sensor.

The pickup roller 33, positioned above the sheet tray 32, has a member having high frictional resistance on its surface. Likewise, the separator roller 34, positioned downstream of the pickup roller 33, has a member having high frictional resistance on its surface. The pickup roller 33 is pressed against the top sheet P on the sheet tray 32 by preselected pressure. A single stepping motor 39 causes the pickup roller 33 and separator roller 34 to rotate clockwise, as viewed in FIG. 1, in synchronism with each other via drive transmitting means, e.g., gears or belts. The reverse roller 35 is pressed against the separator roller 34 by preselected pressure and caused to intermittently rotate clockwise, as viewed in FIG. 1.

The registration roller pair 36 is positioned downstream of the separator roller 34 and reverse roller 35 in the direction of sheet conveyance and made up of a drive roller 36*a* and a driven roller 36*b*. The driving force of drum driving means is transferred to the drive roller 36*a* via gears, cams or similar drive transmitting means, causing the drive roller 36*a* to rotate in synchronism with the print drum 9. The drive roller 36*a* and driven roller, pressed against the drive roller 36*a*, cooperate to convey the sheet P paid out from the tray 32 toward the printing section 2.

The master discharging section 5, located above and at the left-hand side of the printing section 2, includes an upper and a lower discharging member 40 and 41, a waste master box 42, and a compressor 43. The upper discharging member 40 includes a drive roller 44, a driven roller 45 and an endless belt 46 passed over the two rollers 44 and 45. The drive roller 44 is caused to rotate clockwise, as viewed in FIG. 1, by drive means, not shown, moving the belt 46 in a direction indicated by an arrow in FIG. 1. Likewise, the lower discharging member 41 includes a drive roller 47, a driven roller 48 and an endless belt 49 passed over the two rollers 47 and 48. The driving force of the above drive means is transferred to the drive roller 47 via gears, belts or similar drive transmitting means, not shown, causing the drive roller 47 to rotate clockwise, as viewed in FIG. 1. The drive roller 47 thus driven moves the belt 49 in a direction indicated by an arrow in FIG. 1. Moving means, not shown, selectively moves the lower discharging member 41 to a position shown in FIG. 1 or a position where part of the belt 49 passed over the drive roller 47 contacts the circumference of the print drum 9.

The waste master box 42 for storing a used master 50 is removably mounted to the casing 8. When the used master 50 is introduced in the waster master box 42 by the upper and lower discharging members 40 and 41, the compressor 43 is lowered from a position indicated by a solid line to a position indicated by a dotted line by elevating means, not shown, compressing the used master 50.

The sheet discharging section 6, positioned below the master discharging section 5, includes a peeler 51, a conveying unit 52, and a print tray 53. The peeler 51 is pivotably supported by side walls, not shown, included in the sheet discharging section 6 and peels off the sheet or print P from the circumference of the print drum 9. Peeler drive means, not shown, causes the peeler 51 to move between a position where the edge of the peeler 51 adjoins the print drum 9 and a position where the edge does not interfere with, e.g., the damper 15 being moved by the print drum 9.

The conveying unit 52 includes a drive roller 54, a driven roller 55 and an endless belt 56 passed over the two rollers 54 and 55. The drive roller 54 is rotatably supported by the side walls mentioned above and caused to rotate by drive means not shown. The driven roller 54 is also rotatably supported by the above side walls. The belt 56 is formed with a plurality of holes while a suction fan 57 is positioned below the belt 56. The suction fan 57 is mounted on the bottom of a box-like unit body not shown. In this configuration, the sheet P is conveyed by the belt 56 in a direction indicated by an arrow in FIG. 1 while being retained thereon by the suction of the suction fan 57.

The sheet or print P thus conveyed by the conveying unit 52 to the print tray 53 is stacked on the print tray 53. A pair of side fences 58 and an end fence 59 are mounted on the print tray 53. The side fences 58 are movable toward and away from each other in the direction of width of the sheet P while the end fence 59 is movable in the direction of sheet conveyance.

The image reading section 7, positioned in the upper portion of the casing 8, includes a document tray 61 to be loaded with a document or documents 60 and a glass platen 62 on which a document is to be positioned. A roller pair 63 and a roller 64 convey the document 60 while document guides 65 and 66 guide the document 60 being conveyed. A plurality of belts 67 convey the document 60 along the glass platen 62. The document 60 read is stacked on a tray 68. A cover plate 69 supports the above various members except for the glass platen 62 and is angularly movable toward and away from the glass platen 62. A scanning unit 73 includes mirrors 70 and 72 and a lamp or light source 72 for reading the image of the document 60 by scanning it. The resulting reflection from the document 60 is incident to a CCD (Charge Coupled Device) image sensor or similar image sensor 75 via a lens 74.

A document sensor 76 is mounted on the underside of the document tray 61 for determining whether or not any document 60 is left on the tray 61. A document size sensor 77 is positioned beneath the glass platen 62 for determining whether or not a document laid by hand or fed from the document tray 61 is present as well as the size of the document. The roller pair 63 and scanning unit 73 are driven by stepping motors 78 and 79, respectively.

Figure 2:
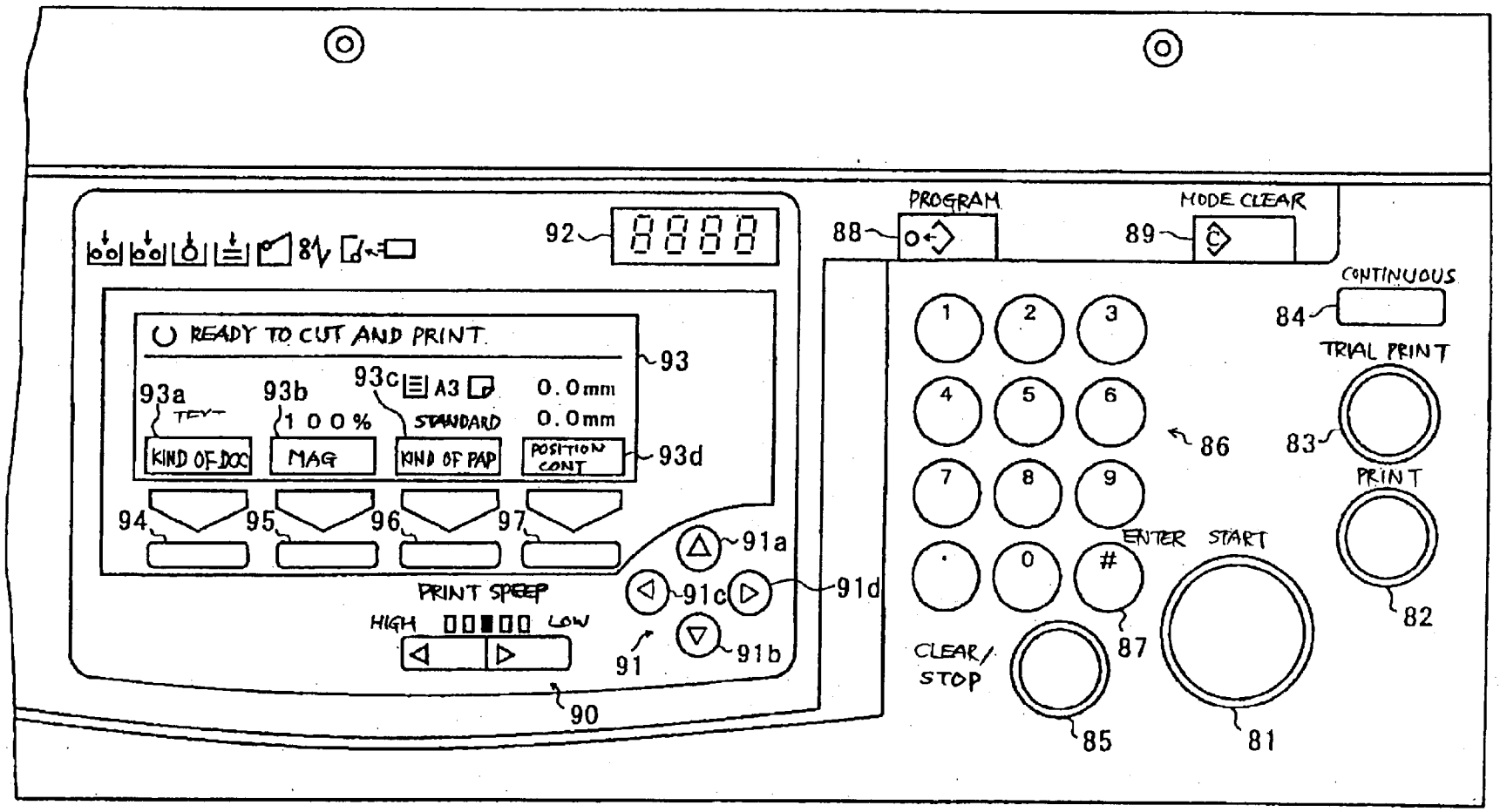
FIG. 2 is a plan view showing a specific configuration of a control panel included in the illustrative embodiment.

FIG. 2 shows a specific configuration of a control panel mounted on the top of the stencil printer 1. As shown, the control panel, generally 80, includes a perforation start key 81, a print start key 82, a trial print key 83, a continues key 84, a clear/stop key 85, ten keys 86, an enter key 87, a program key 88, a mode clear key 89, print speed keys 90, four direction keys 91*a* through 91*d* (collectively labeled 91), a display 92 implemented by seven-segment LEDs (Light Emitting Diodes), and a display 93 implemented by an LCD (Liquid Crystal Display) panel.

When the operator of the stencil printer 1 presses the perforation start key 81 after setting various master making conditions, a master discharging and an image reading operation are executed and followed by a master making operation. After the resulting master has been wrapped around the print drum 9, the printer 1 is held in a stand-by state. Subsequently, when the operator presses the print start key 82 after setting desired printing conditions, a printing operation is executed. Further, when the operator presses the trial print key 83 after setting various conditions, a single trial print is produced. The operator may press the continuous key 84 when desiring to cause the printer 1 to perform the master making operation and printing operation continuously. In this case, after the operator, pressed the continuous key 84, has input master making conditions and printing conditions, the operator presses the perforation start key 81. In response, after the master discharging operation, image reading operation and master making operation, the printing operation is executed.

The clear/stop key 85 is pressed to interrupt the operation of the printer 1 or to clear a numerical value input by the operator. The ten keys 86 allow the operator to input desired numerical values while the enter key 87 allows the operator to enter, e.g., numerical values in the event of setting. The mode clear key 89 clears various modes input by the operator when pressed. By using the print speed keys 90 before the start of printing operation, the operator may lower the print speed when, e.g., desiring a relatively dark image or when temperature around the printer 1 is low or may raise the print speed when desiring a relatively light image or when temperature is high. The four direction keys 91*a* through 91*d* allow the operator to adjust the position of an image in the event of editing or to select numerical values and items in the event of setting.

The LED display 92 mainly displays the desired number of prints. As shown in FIG. 2, the LCD panel 93 initially displays a picture including the kind of a document (Kind of Doc) 93*a*, a magnification (Mag) 93*b*, the kind of a sheet (Kind of Pap) 93*c* and a position control (Position Cont) 93*d* as well as select/set keys 94 through 97 respectively corresponding to the above items. The display 93 has a hierarchical display structure although not shown specifically. For example, when the select/set key 94 is pressed, a kind-of-document mode is established, so that the display 93 displays a document image mode picture including a text mode and a photo mode. When the select/set key 95 is pressed, the display 93 displays a magnification mode picture including an automatic magnification change and an independent magnification change. When the select/set key 96 is pressed, the display 93 displays a kind-of-paper mode picture including standard papers and thick papers. Further, when the select/set key 97 is pressed, the display 93 displays a position control mode allowing the operator to control a print position.

Figure 3:
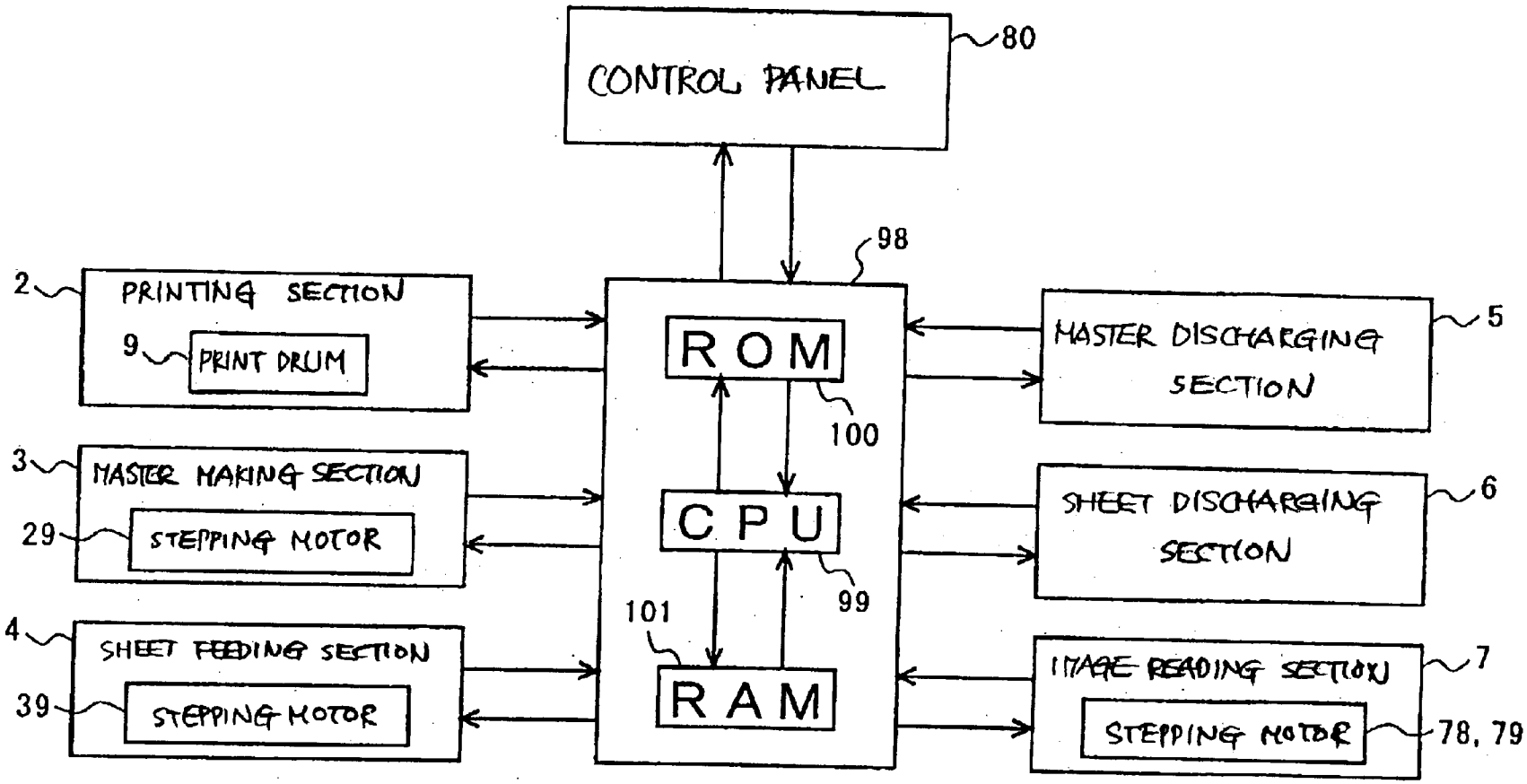
FIG. 3 is a schematic block diagram showing a control system included in the illustrative embodiment.

FIG. 3 shows the configuration of the control means 98 mentioned earlier. As shown, the control means 98 is implemented as a microcomputer including a CPU (Central Processing Unit) 99, a ROM (Read Only Memory), and a RAM (Random Access Memory 101. The ROM 100 stores a program for controlling the entire printer 1. The RAM 101 stores the kind of documents, magnification and other master making conditions, the desired number of prints, print speed and other printing conditions, and how far the operation of the printer 1 has advanced. The RAM 101 is backed up by a battery, not shown, so that data stored in the RAM 101 are not deleted even when the main power supply of the printer 1 is turned off.

The operation of the printer 1 having the above configuration will be described hereinafter. First, the operator lays a document 60 on the glass platen 62, sets various master making conditions on the select/set keys 94 through 97, and then presses the perforation start key 81. In response, the drum driving means starts rotating the print drum 9 clockwise, as viewed in FIG. 1. When the leading edge of the used master 50 present on the print drum 9 arrives at a position facing the drive roller 47, the moving means moves the lower discharging member 41 until part of the belt 49 passed over the drive roller 47 contacts the used master 50. At this position, the lower discharging member 41 lifts the used master 50 away from the print drum 9, and then the two discharging members 40 and 41 cooperate to nip and convey the used master 50 in accordance with the rotation of the print drum 9. After the used master 50 has been introduced in the waste master box 42, the compressor 43 is lowered to compress the used master 50. After the master discharging operation, the print drum 9 is further rotated to a stand-by position where the damper 15 faces sideways at the right-hand side in FIG. 1, and then stopped at the stand-by position. Subsequently, opening/closing means, not shown, causes the damper 15 to open. In this condition, the printer 1 waits for a master.

After the master discharging operation, the scanning unit 73 is moved to the right, as viewed in FIG. 1, while scanning the document 60. The resulting imagewise light is incident to the image sensor 75 via the lens 74 and converted to an image data signal thereby. The image data signal is sent to a thermal head driver, not shown, via the control means 98. When the document 60 is positioned on the document tray 61 with the document sensor 60 sensing it, the roller pair 63 and belt 67 are driven to convey the document 60 to the glass platen 62. When the document size sensor 77 senses the document 60, the scanning unit 73 is moved to scan the document 60 in the same manner as it scans the document 60 laid on the glass platen 62 by hand. In any case, the document 60 thus read is conveyed by the belt 87 and roller 64 away from the glass platen 62 to the tray 68.

After the printer 1 has been brought to the stand-by state, a master making operation begins. More specifically, after the damper 15 has been opened, as stated earlier, the stepping motor 29 is energized to rotate the platen roller 22 with the result that the stencil 27 is paid out from the roll 28. When the stencil 27 is conveyed via the thermal head 23, the thermal head driver causes the heat generating elements to selectively generate heat, thereby perforating, or cutting, the thermoplastic resin film of the stencil 27. The roller pair 25, rotating at slightly higher peripheral speed than the platen roller 22, conveys the perforated part of the stencil or master 27, so that tension acts on the stencil 27 between the platen roller 22 and the roller pair 25.

The control means 98 determines, based on the number of steps of the stepping motor 29, that the leading edge of the stencil 27, which is conveyed by the platen roller 22 and roller pairs 25 and 26 along the guides 30 and 31, has reached a preselected position between the stage 14 and the clamper 15. The control means 98 then causes the opening/closing means to close the damper 15 and causes the drum drive means to again rotate the print drum 9 at peripheral speed substantially equal to the moving speed of the stencil 27. As a result, the perforated part of the stencil 27 is wrapped around the print drum 9. When the control means 98 determines, based on the number of steps of the stepping motor 29, that the stencil 27 has been perforated and conveyed by the length of a single master, the control means 98 causes the cutting means 24 to cut away the perforated part of the stencil 27 and causes the platen roller 22 and roller pairs 25 and 26 to stop rotating. The part of the stencil thus cut away, i.e., a master 27 is pulled out from the master making section 3 by the rotation of the print drum 9 and fully wrapped around the print drum 9.

Subsequently, the pickup roller and separator roller 34 are rotated to pay out a single sheet P from the sheet tray 32 while the print drum 9 is rotated clockwise at low speed. The registration roller pair 36 once stops the sheet P paid out from the sheet tray 32 and again conveys it toward a position between the print drum 9 and the press roller 11 at preselected timing. As soon as the leading edge of the sheet P arrives at a preselected position, press roller moving means, not shown, moves the press roller 11 into pressing contact with the print drum 9. As a result, the ink fed to the inner periphery of the print drum 9 by the ink feeding means 10 is transferred to the sheet P via the porous portion of the print drum 9 and the perforations of the master 27 while being filled in the porous support of the master 27. As a result, the master 27 and print drum 9 are caused to closely adhere each other.

The sheet P with the ink thus transferred thereto is peeled off from the print drum 9 by the peeler 51 and then drop onto the conveying unit 52. In the conveying unit 52, the sheet P is conveyed by the belt 56 to the left, as viewed in FIG. 1, while being retained thereon by the suction of the suction fan 57. Finally, the sheet P is driven out to the print tray 53. After the procedure described so far, the printer 1 remains in a stand-by state.

When the operator inputs desired printing conditions on any desired keys including the print speed keys 90 and then presses the trial pint key 83, the print drum 9 is rotated clockwise at peripheral speed corresponding to a desired print speed. At the same time, the pickup roller 33 and separator roller 34 are rotated to pay out a single sheet P from the sheet tray 32. The sheet P is then conveyed to the printing section 2 at preselected timing via the registration roller pair 36. In the printing section 2, the press roller 1 presses the sheet P against the print drum 9 with the result that an image is transferred to one side of the sheet P. The sheet P, carrying the image thereon, is peeled off from the print drum 9 by the peeler 51 and then conveyed to the print tray 53 by the conveying unit 52 as a trial print.

If the operator, looking at the trial print driven out to the print tray 53, determines that the image is desirable as to, e.g., position and density, then the operator inputs desired printing conditions on, e.g., the ten keys 86 and print speed keys 90 and then presses the print start key 82. In response, the print drum 9 is rotated clockwise at peripheral speed corresponding to a desired print speed. At the same time, the pickup roller 33 and separator roller 34 are rotated to continuously feed the sheets P from the tray 32 one by one. As a result, images are formed on one side of the consecutive sheets P in the same manner as during trial printing. The sheets P, carrying the images thereon, are sequentially stacked on the print tray 53 as prints. When the desired number of prints are fully output, the various sections of the printer 1 are caused to stop operating, i.e., the printer 1 is again held in the stand-by state.

During the operation described above, the control means 98 constantly monitors the operating conditions of the printer 1 in accordance with the output of the encoder responsive to the position of the print drum 9, the numbers of steps of the stepping motors 29 and 39, and statuses of the various drive means. In the control means 98, the history of the operation of the printer 1 is written to the RAM 101 while being sequentially updated. The various conditions input before the consecutive operations are also written to the RAM 101 while being sequentially updated.

Now, assume that the main power supply of the printer 1 is accidentally turned off by the operator or due to a power failure or the operation of a circuit breaker when the printer is performing the operation described above. Then, the printer 1 immediately stop the operation. However, in the illustrative embodiment, the instantaneous conditions of the printer 1 are constantly written to the RAM 101 while being sequentially updated. Therefore, in the event of the accidental turn-off of the main power supply, the conditions stored in the RAM 101 are called as soon as the main power supply is again turned on later. The control means 98 can therefore determine, on the turn-on of the main power supply, whether the printer 1 has stopped operating in a usual state or whether it has done so due to an error (accidental stop). More specifically, the control means 98 can determine whether or not the main power supply has been turned off during the interval between the time when the stencil 27 paid out from the roll 28 starts being perforated and the time when it is cut by the cutting means 24. Stated another way, the control means 98 can determine whether or not the main power supply has been turned off after the leading edge of the stencil 27, held at a halt at the cutting means 24, has been clamped by the damper 25 via the platen roller 22 and roller pairs 25 and 26, bur before the stencil 27 is fully wrapped around the print drum 6 by the length of a single master and then cut by the cutting means 24. In this sense, the control means 98 plays the role of deciding means.

If the main power supply is turned off during the interval stated above, then the problems previously described in relation to the prior art technologies arise. The illustrative embodiment solves such problems with the following procedure. When the stencil 27 is not fully wrapped around the print drum 9 by the length of a single master at the time of turn-off of the main power supply, the cutting means 24 is caused to cut the stencil 27 being perforated. Subsequently, after the portion of the stencil 27 thus cut away has been fully wrapped around the print drum 9, it is discharged by the master discharging section 5.

The above procedure unique to the illustrative embodiment makes it unnecessary for the operator to remove the cut piece of the stencil 27 with hand, thereby enhancing efficient work. Further, in the illustrative embodiment, when the portion of the stencil 27 cut away and wrapped around the print drum 9 is removed from the print drum 9 and discharged by the automatic procedure, a sensor, not shown, senses the absence of the stencil 27 on the print drum 9 and inhibits printing from being effected. This successfully obviates the problems discussed earlier in relation to the prior art technologies.

On the other hand, assume that the stencil 27 is not wrapped around the print drum 9 at all at the time of turn-off of the power supply. Then, the platen roller 22 and roller pairs 25 and 26 are driven to convey the stencil 27 until the leading edge of the stencil 27 has been clamped by the damper 15 and then wrapped around the print drum 9. As soon as the stencil 27 is conveyed by a length great enough to be discharged by the master discharging section 5, the cutting means 24 cuts the stencil 27. Whether or not the stencil 27 is present on the print drum 9 can be determined on the basis of the number of steps of the stepping motor 29. This is also successful to obviate the problems of the prior art technologies.

Various modifications will become possible for those skilled in the art after receiving the teachings of the present disclosure without departing from the scope thereof.

What is claimed is:

1. A stencil printer comprising:

a print drum around which a master is to be wrapped;

master making means for making a master and including cutting means for cutting the master paid out from a roll;

master discharging means for removing the master wrapped around said print drum and discharging said master; and deciding means for determining, on a turn-on of a power supply, whether or not said power supply has been turned off during an interval between a time when the master paid out from the roll starts being perforated and a time when said cutting means cuts said master;

wherein when said deciding means determines that the power supply has been turned off during said interval, said master discharging means discharges the master.

2. The stencil printer as claimed in claim 1, wherein if the master is present on said print drum when said deciding means determines that the power supply has been turned off during said interval, then the stencil is discharged after being cut by said cutting means.

3. The stencil printer as claimed in claim 1, wherein if the master is absent on said print drum when said deciding means determines that the power supply has been turned off during said interval, then the master is conveyed to be wrapped around said print drum, cut by said cutting means, and then discharged by said master discharging means.

4. A stencil printer comprising:

a print drum around which a master is to be wrapped;

a master making section configured to make a master and including a cutter for cutting the master paid out from a roll;

a master discharging section configured to remove the master wrapped around said print drum and discharge said master; and a deciding device configured to determine, on a turn-on of a power supply, whether or not said power supply has been turned off during an interval between a time when the master paid out from the roll starts being perforated and a time when said cutter cuts said master;

wherein when said deciding device determines that the power supply has been turned off during said interval, said master discharging section discharges the master.

5. The stencil printer as claimed in claim 4, wherein if the master is present on said print drum when said deciding device determines that the power supply has been turned off during said interval, then the stencil is discharged after being cut by said cutter.

6. The stencil printer as claimed in claim 4, wherein if the master is absent on said print drum when said deciding device determines that the power supply has been turned off during said interval, then the master is conveyed to be wrapped around said print drum, cut by said cutter, and then discharged by said master discharging section.

* * * * *